US010344503B2

(12) United States Patent
Viveiros

(10) Patent No.: US 10,344,503 B2
(45) Date of Patent: Jul. 9, 2019

(54) SURFBOARD LOCKING SYSTEM

(71) Applicant: Todd Viveiros, Oceanside, CA (US)

(72) Inventor: Todd Viveiros, Oceanside, CA (US)

( * ) Notice: Subject to any disclaimer, the term of this patent is extended or adjusted under 35 U.S.C. 154(b) by 0 days.

(21) Appl. No.: 15/840,873

(22) Filed: Dec. 13, 2017

(65) Prior Publication Data

US 2018/0179787 A1 Jun. 28, 2018

Related U.S. Application Data

(60) Provisional application No. 62/439,812, filed on Dec. 28, 2016.

(51) Int. Cl.

| | |
|---|---|
| ***E05B 73/00*** | (2006.01) |
| ***B63B 35/79*** | (2006.01) |
| ***E05B 65/00*** | (2006.01) |
| *E05B 67/38* | (2006.01) |
| *B63B 17/00* | (2006.01) |

(52) U.S. Cl.

CPC ..... *E05B 73/007* (2013.01); *B63B 35/793* (2013.01); *B63B 35/7933* (2013.01); *E05B 65/00* (2013.01); *E05B 73/0005* (2013.01); *B63B 2017/0009* (2013.01); *E05B 67/383* (2013.01)

(58) Field of Classification Search

CPC ..... E05B 65/00; E05B 73/00; E05B 73/0005; E05B 73/007; E05B 73/0094

See application file for complete search history.

(56) References Cited

U.S. PATENT DOCUMENTS

| | | | | | |
|---|---|---|---|---|---|
| 4,340,376 | A * | 7/1982 | Williams | E05B 73/007 | 441/74 |
| 4,680,949 | A * | 7/1987 | Stewart | E05B 73/007 | 70/14 |
| 4,712,394 | A * | 12/1987 | Bull | E05B 73/0005 | 441/74 |
| 4,938,040 | A * | 7/1990 | Humphreys, Jr. | E05B 73/0005 | 70/14 |
| 5,109,683 | A * | 5/1992 | Cartwright | B63B 35/7946 | 70/14 |
| 5,119,649 | A * | 6/1992 | Spence | B63B 35/7946 | 114/172 |
| 5,832,754 | A * | 11/1998 | McKenzie | B63B 35/7933 | 70/58 |
| 6,691,537 | B2 * | 2/2004 | Tan | B63B 35/7933 | 403/315 |
| 6,763,689 | B1 * | 7/2004 | Thomas | E05B 73/007 | 441/74 |

(Continued)

*Primary Examiner* — Christopher J Boswell

(74) *Attorney, Agent, or Firm* — Knobbe Martens Olson & Bear LLP

(57) ABSTRACT

A surfboard locking system includes a device for providing a securement point allowing a surfboard to be secured to a lock. The device includes at least a first piece and a second piece, each piece sized and shaped to be insertable into a fin box opening of a surfboard fin box. The first and second pieces are pieces couplable together within the fin box to form a securement, the securement sized and shaped such that the securement cannot be removed through the fin box opening. One of the pieces can include a passageway sized and shaped to accommodate a portion of a lock, such as the shackle of a padlock, to allow the surfboard to be securely locked to a cable or other object.

12 Claims, 13 Drawing Sheets

(56) References Cited

U.S. PATENT DOCUMENTS

| | | | | |
|---|---|---|---|---|
| 7,013,684 | B2 * | 3/2006 | Hooks, Jr. | E05B 73/007 24/598.5 |
| 7,294,032 | B1 * | 11/2007 | Ventura | B63J 99/00 441/75 |
| 7,640,772 | B2 * | 1/2010 | Johnson | E05B 73/0005 114/172 |
| 2017/0175425 | A1 * | 6/2017 | Westbrook | E05B 73/007 |

* cited by examiner

SURFBOARD LOCKING SYSTEM

CROSS-REFERENCE TO RELATED APPLICATIONS

This applications claims the benefit of priority under 35 U.S.C. § 119(e) of U.S. Provisional Application No. 62/439,812, filed Dec. 28, 2016, titled "SURFBOARD LOCKING SYSTEM," which is incorporated herein by reference in its entirety and for all purposes.

BACKGROUND

Surfboards, due to their shape and size, are not easily and effectively secured to a car rack, bike rack, pole, and the like. Unlike, for example, bikes, surfboards have no openings or securement points for a strap, chain, or bike lock.

SUMMARY

Disclosed herein is a surfboard locking system for preventing and deterring surfboard theft. More particularly, disclosed herein is a device configured to be insertable into a surfboard fin box to provide a securement point for a lock. The securement point may comprise an opening configured to receive at least a portion of a lock. In some aspects, the opening is configured to receive a shackle portion of a padlock.

The device may be further configured such that it cannot be removed from the fin box. In some aspects, the device may be configured such that it cannot be removed from the fin box at least when a shackle of a padlock is inserted through the opening in the device.

The device may comprise at least two pieces. Each of the two pieces may be removably couplable together. Separately, each piece of the device may be sized and shaped to be insertable into at least one fin box of a surfboard. When coupled together, the pieces may form a device that is sized and shaped such that it cannot be removed from the at least one fin box of the surfboard.

In some aspects, the device is formed of two pieces that are separately insertable into a fin box—but when the two pieces are joined, the device is not insertable into the fin box (and also not removable from the fin box when the two pieces are combined). The two pieces may be joined together by at least one screw. The screw may be a screw that is the same or similar to screws that are typically used in connection with fin boxes. In some aspects, the screw may be compatible with fin keys that are available in the art. In this way, no additional or specialized torqueing device is needed to install the device. In some aspects, the coupling between the two pieces is configured to be covered and thus rendered inaccessible at least when a portion of a lock is inserted through the device.

In one embodiment, a surfboard locking system is described. The surfboard locking system comprises a securement capable of being inserted into a fin box of a surfboard. The securement has at least one opening therethrough capable of receiving at least a portion of a lock, the securement sized and shaped such that a surfboard fin and the securement may be disposed within the fin box at the same time.

The at least a portion of a lock can comprise at least a portion of a shackle of a padlock. The securement can be sized and shaped to not protrude from the fin box when disposed within the fin box. The securement can be configured to be retained within the fin box without substantially affecting the performance of the surfboard. The securement can be removable from the fin box by disassembling the securement into at least two pieces, each piece being individually removable from the fin box. The securement can be not disassemblable while the at least a portion of a lock is disposed within the at least one opening. The securement can comprise a central portion having a width less than 0.9 cm and a retention portion having a width greater than 0.9 cm.

In another embodiment, a device providing a securement point for a surfboard is described. The device comprises a first piece sized and shaped to be insertable into a fin box opening of a fin box of a surfboard, and a second piece sized and shaped to be insertable into the fin box opening. The first and second pieces are couplable together within the fin box to form a securement, the securement sized and shaped such that the securement cannot be removed through the fin box opening.

The device can include at least one passageway therethrough. The at least one passageway can be sized and shaped to receive a shackle of a padlock. The first piece can comprise at least one opening and the second piece can comprise at least one threaded hole, such that the first and second pieces can be coupled together within the fin box by driving a screw through the at least one opening into the at least one threaded hole. The securement can comprise a passageway sized and shaped to receive a shackle of a padlock, the passageway located such that a shackle disposed within the passageway prevents access to the at least one opening. The first and second pieces can comprise at least one of a metal, an epoxy, and a plastic. The first piece can comprise a central portion and one or more outcroppings wider than the central portion, the outcroppings sized and shaped to be contained within a rut of the fin box, the central portion configured to extend through a central channel of the fin box toward an exterior of the surfboard. The second piece can comprise a base and a rudder wider than the base, the rudder sized and shaped to be contained within a rut of the fin box, the central portion configured to support the first piece. The first piece and the second piece can be securable together while the outcroppings and the rudder are disposed within the rut of the fin box. At least one of the first piece and the second piece can comprise an angled portion configured to facilitate insertion of the securement into the fin box. The first piece can comprise a central portion having a width of less than 0.9 cm and a retention portion having a width greater than 0.9 cm. The second piece can comprise a base having a width less than 0.9 cm and a rudder having a width greater than 0.9 cm. The retention portion and the rudder can be substantially aligned when the first and second pieces are secured together.

BRIEF DESCRIPTION OF THE DRAWINGS

In FIG. 5, the piece from FIG. 2 is inserted downward through the opening in the fin box. FIG. 6 shows how the piece is rotated and slid into the fin box channel. FIG. 8 shows the piece of FIG. 1 being inserted downward through the opening in the fin box. FIGS. 9 and 10 show how the piece is rotated and slid into the fin box channel.

DETAILED DESCRIPTION OF THE PREFERRED EMBODIMENT

Various aspects of the novel systems, apparatuses, and methods are described more fully hereinafter with reference to the accompanying drawings. Aspects of this disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein, one skilled in the art should appreciate that the scope of the disclosure is intended to cover any aspect of the novel systems, apparatuses, and methods disclosed herein, whether implemented independently of or combined with any other aspect. For example, an apparatus may be implemented or a method may be practiced using any number of the aspects set forth herein. In addition, the scope is intended to encompass such an apparatus or method which is practiced using other structure, functionality, or structure and functionality in addition to or other than the various aspects set forth herein. It should be understood that any aspect disclosed herein may be embodied by one or more elements of a claim.

Figure 1:
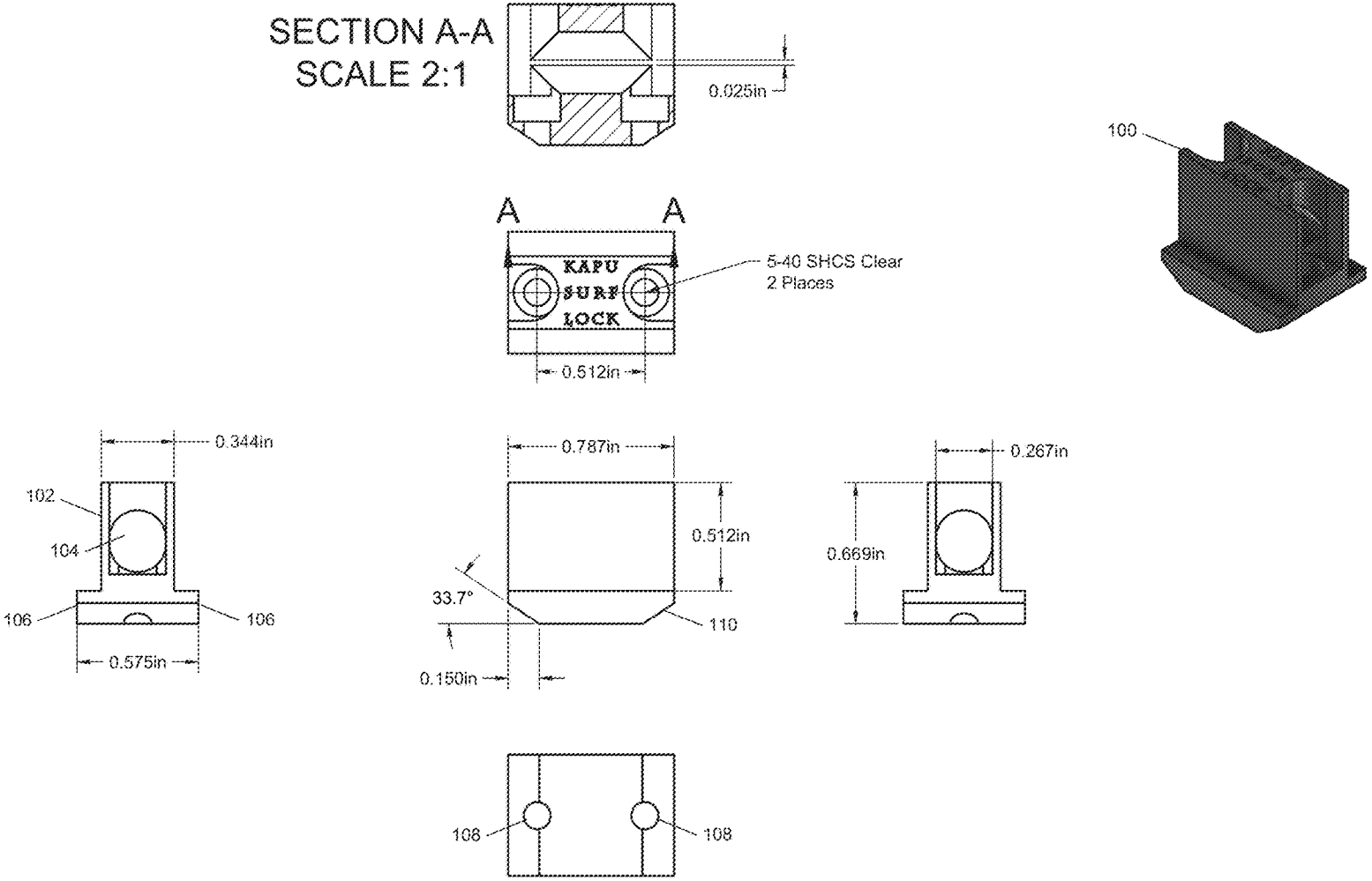
FIG. 1 is an engineering design drawing of a first piece of device for providing a securement point for a surfboard according to one embodiment. As shown, the first piece may include two transverse openings configured to receive at least a portion of at least two screws. The first piece may also include a longitudinal opening or passageway configured to receive a portion of a lock.
Figure 2:
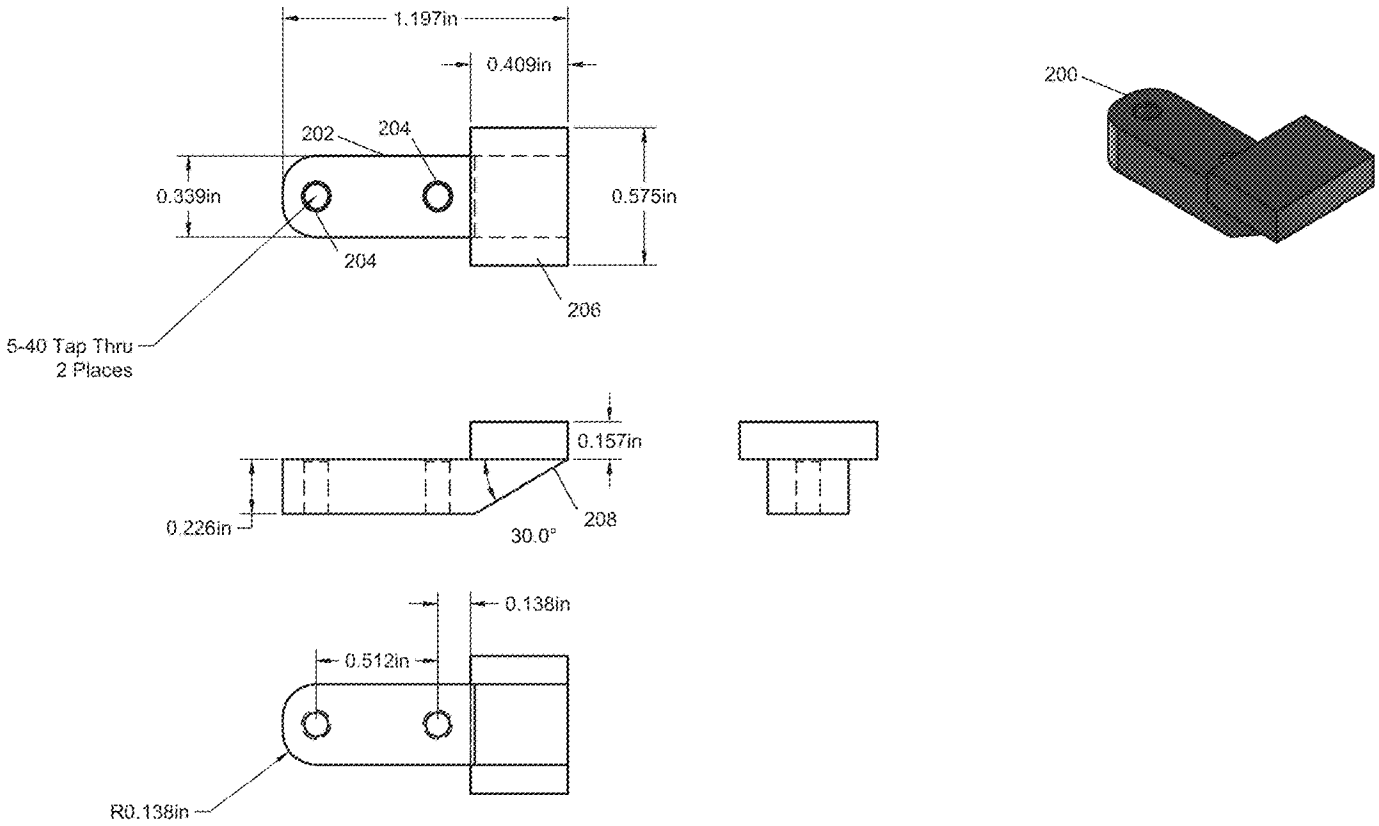
FIG. 2 is an engineering design drawing of a second piece of device for providing a securement point for a surfboard according to one embodiment. The second piece may be coupled to the first piece shown in FIG. 1. As shown, the second piece may include two transverse openings configured to receive at least a portion of at least two screws. The two screws may secure the first and second piece together.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. The detailed description and drawings are merely illustrative of the disclosure rather than limiting, the scope of the disclosure being defined by the appended claims and equivalents thereof. It should be understood that the various dimensions and angles indicated in FIGS. 1 and 2 are merely dimensions of individual non-limiting example embodiments, and all dimensions and/or angles indicated therein may be increased, decreased, or otherwise altered without departing from the scope of the present disclosure.

Surfboards, due to their shape and size, are not easily and effectively secured to a car rack, bike rack, pole, and the like. Unlike, for example, bikes, surfboards have no openings or securement points for a strap, chain, or bike lock. The present disclosure solves this problem by providing a device, insertable into a fin box, which provides a securement point for a strap, chain, bike lock, padlock, and the like. Thus, by using the device, a surfboard may be locked to a car rack, bike rack, pole, and the like. Such a device will deter and prevent surfboard theft.

The device may have a low profile and, when installed, may not substantially protrude out of the fin box (and may have a top surface below the top of the fin box) such that it is not easily visible and does not adversely affect surfboard performance. In some aspect, the device does not protrude at all from the fin box. In some aspects the device is flush with the top of the fin box channel. In some aspects, the total height of the device is less than the height of the fin box channel.

The device may also be configured such that its insertion into a fin box does not prevent a fin from also being inserted into the fin box. In this way, the device may be at least semi-permanently installed into a fin box and there is no need to insert or remove the device from the fin box repeatedly for each and every use. For example, the device may be installed within the fin box and may remain in the fin box while the surfboard is used for surfing, without substantially affecting the performance of the surfboard.

The device may be made of any suitable material. For example, hard plastics, metals, and/or epoxy materials may be used. In a preferred embodiment, the device comprises marine grade stainless steel.

Fin boxes are predominately designed as described below. A surfboard commonly has at least one fin box disposed in the underside of the board towards the rear of the board and centered in the middle of the board. Such fin boxes usually include a channel generally parallel to the length of the board. The interior of the channel includes a rut that is slightly wider than the central channel. The central channel also includes a slightly wider opening at or near the center of the channel. When installing a fin, a nut is first inserted through the slightly wider opening at or near the center of the channel and slid towards the front of the board in the rut. The rear of the fin includes at least two tabs extending away from the fin. The rear of the fin is inserted into the slightly wider opening at or near the center of the channel and the tabs are positioned within the rut. The tabs are then slid backwards towards the rear of the board. The front of the fin includes a hole therethrough. The hole is positioned above the nut that was previously inserted and a screw is passed through the opening in the front of the fin and secured to the nut to secure the fin within the fin box.

In some aspects, the fin box is a fin box configured for use with a stand up paddle board (a "SUP"). However, any sized fin box is contemplated. For example, the fin box may be configured for use with long boards or short boards. Typically, the fin box is the central or primary fin box of the particular surfboard or SUP.

To assist in the description of the components of the securement device, the following coordinate terms are used. A "longitudinal axis" is generally parallel to a portion of the device and the fin box that extends lengthwise from the front of the board to the rear of the board. A "lateral axis" is normal to the longitudinal axis and extends from one side of the board to the other. A "transverse axis" extends normal to both the longitudinal and lateral axes and extends vertically up and down with respect to the board.

Figure 18:
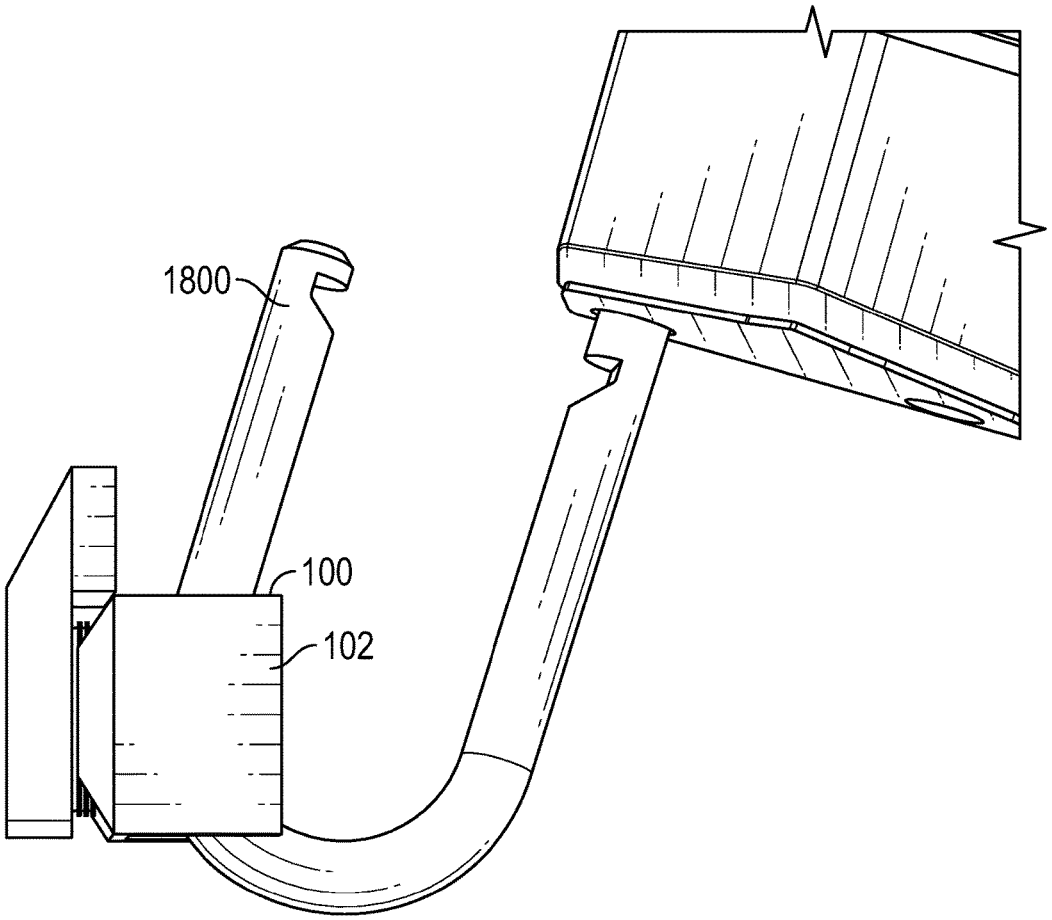
FIG. 18 is a side view showing the shackle of a pad lock inserted through a passageway in the device.
Figure 19:
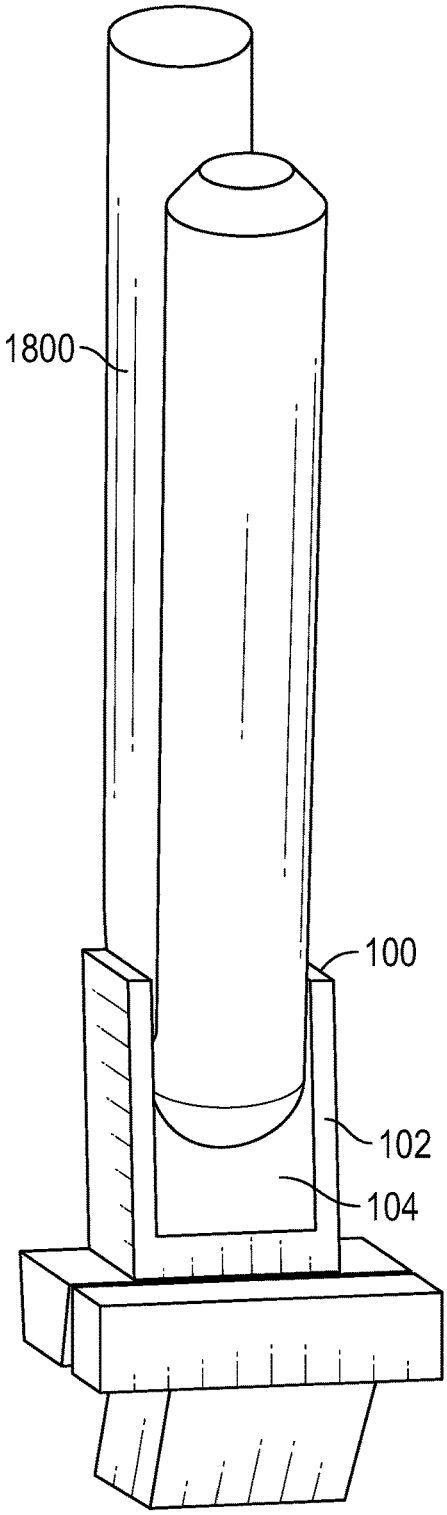
FIG. 19 is a head on view of FIG. 18.

In some aspects, the device comprises two parts that are couplable together. As shown in FIG. 1, the first piece 100 may comprise a central section 102 extending in the transverse direction. The central section includes a passageway 104 extending longitudinally therethrough. The passageway 104 may be used as a securement point for a lock, chain, strap, cord, or the like. In this way, a lock, chain, strap, cord, or the like may be secured to the surfboard. Another portion of the lock, chain, strap, cord, or the like may be coupled to a relatively fixed object such as a pole, car rack, bike rack or the like. In some aspects, the securement point is used to secure a large and/or heavy object to the board such that the use of the surfboard is impaired. As shown in FIGS. 18-19, the shackle 1800 of a padlock may be inserted through the passageway 104. The padlock may be used to secure a chain or cord to the surfboard.

Figure 8:
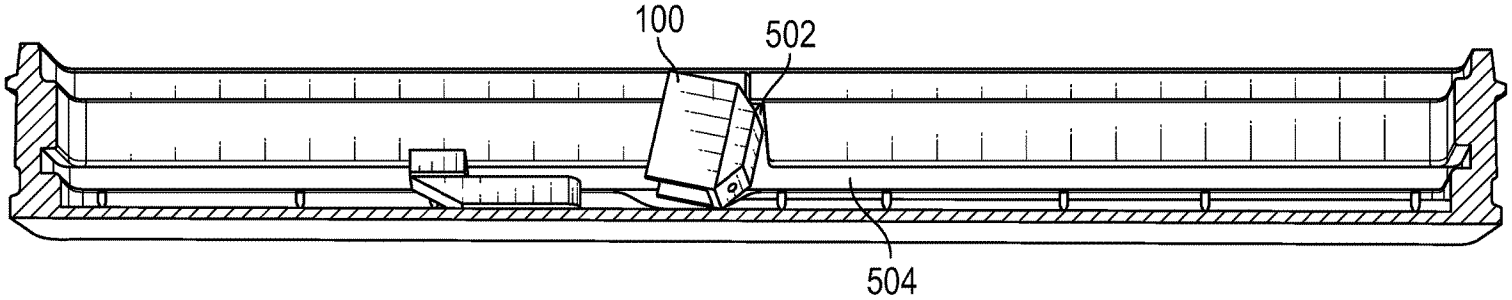
Figure 9:
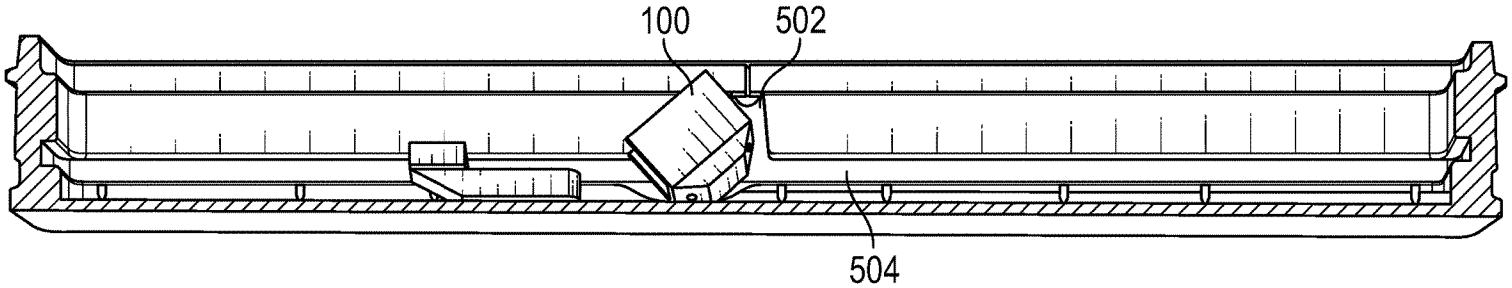
Figure 10:
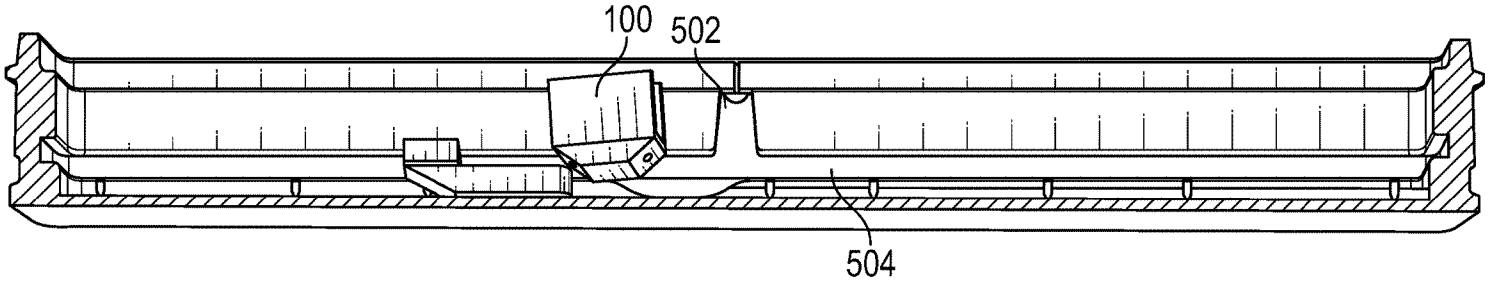

The first piece 100 may be sized and shaped such that it may be passed into a channel in a fin box. As shown, in FIG. 1, the first piece 100 may include two laterally extending outcroppings 106. These outcroppings 106 may be configured to slide through the rut in the channel. As shown in FIGS. 8-10, the first piece 100 may be inserted into the opening 502 at or near the center of the channel 504 and can make the turn required such that it may slide along the ruts in the channel 504. For example, in some cases a standard center fin box may have a channel having a width of approximately 0.9 cm, or 0.354 inches. Thus, at least some of the dimensions of the first piece 100 may be selected based on the standard width such that the central section 102 has a width smaller than 0.9 cm or 0.354 inches (for example, 0.344 inches) so that the central section 102 can fit within the channel, while the outcroppings 106 together form a retention portion having a width of greater than 0.9 cm or 0.354 inches (for example, 0.575 inches) so that the outcroppings 106 will be retained within the rut of the channel because they cannot fit through the channel width. As shown in the overhead plan view at the bottom of FIG. 1, the first piece may include two transverse openings 108 for receiving a fastener or connector, such as a screw. The transverse openings 108 may or may not be threaded.

As shown in the side view in the middle of FIG. 1, the bottom portion 110 may be angled (for example at 33.7°) from the horizontal. This angled portion may ease the insertion of the device into the fin box. In other words, the device may be shaped to more easily allow the first piece 100 to make the turn required to be inserted into the fin box.

Figure 3:
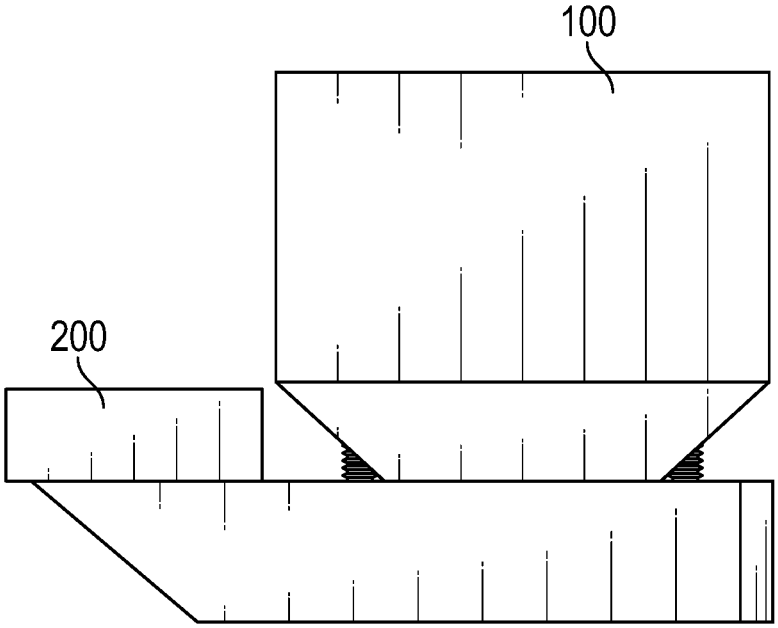
FIG. 3 is a side view of the first and second pieces coupled together to form the device.
Figure 4:
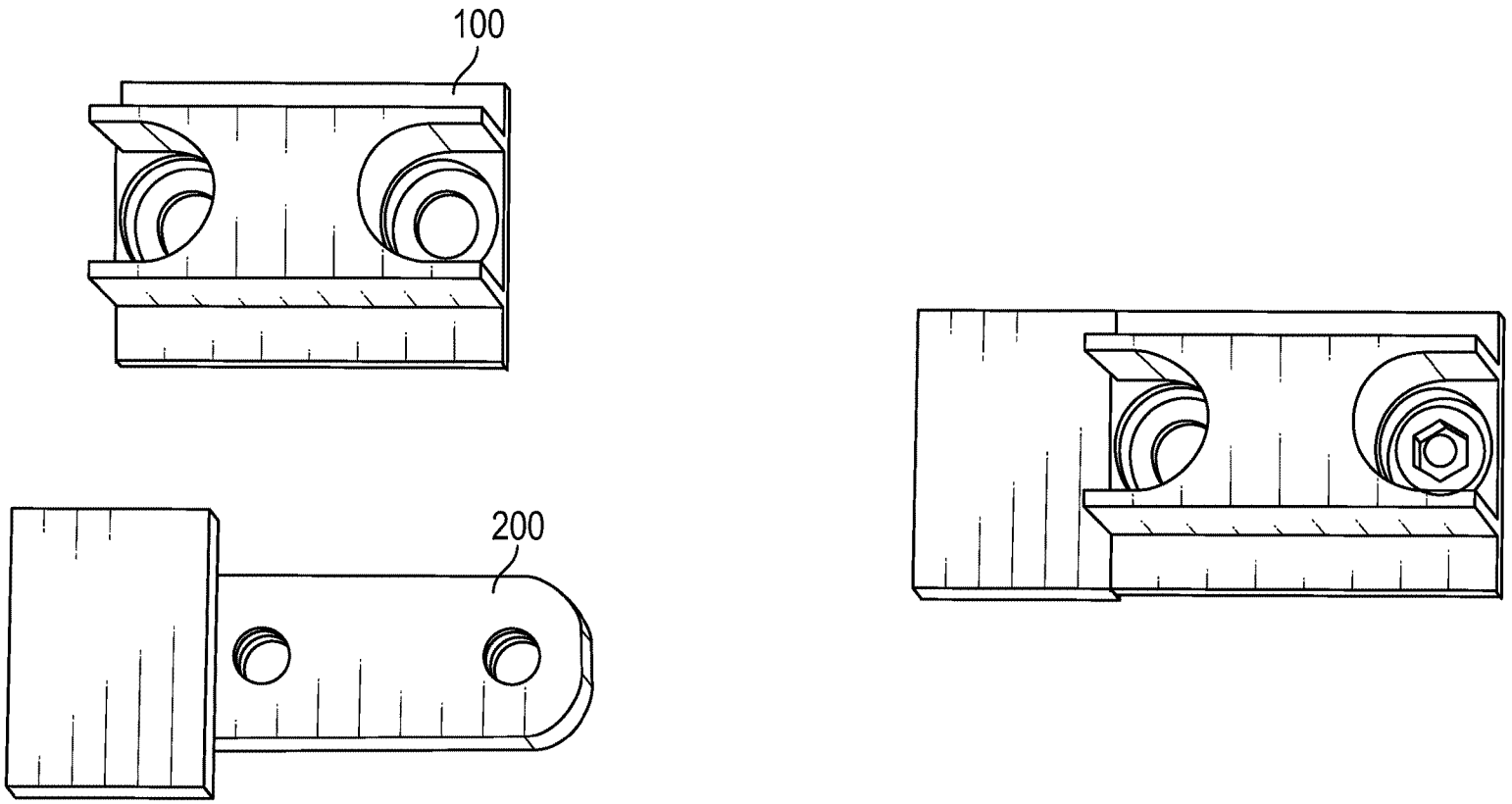
FIG. 4 is an overhead view of the devices of FIGS. 1-3. The pieces are uncoupled on the left hand side and coupled together on the right hand side.

As shown in FIG. 2, the second piece 200 may include a base 202 configured to support the first piece 100 from below. The base 202 may include two through holes 204. The through holes 204 may be threaded. A fastener, such as a screw, may be passed through the through holes 204 and through the two transverse openings 108 in the first piece 100 to form the device of FIG. 3. The second piece may also include a rudder 206 for insertion into the rut of the surfboard channel. As shown in the side view in the center of FIG. 2, the second piece may include an angled section 208 (for example at 30.0°) from the horizontal. The angled section 208 may ease insertion of the second piece 200 into the fin box. Similar to the first piece 100, the dimensions of the second piece 200 may be selected based at least in part on a standard center fin box channel width of approximately 0.9 cm, or 0.354 inches. Thus, the dimensions of the second piece 200 may be selected such that the base 202 has a width smaller than 0.9 cm or 0.354 inches (for example, 0.339 inches) so that the base 202 can fit within the channel, while the rudder 206 has a width of greater than 0.9 cm or 0.354 inches (for example, 0.575 inches) so that the rudder 206 will be retained within the rut of the channel because it cannot fit through the channel width.

Figure 5:
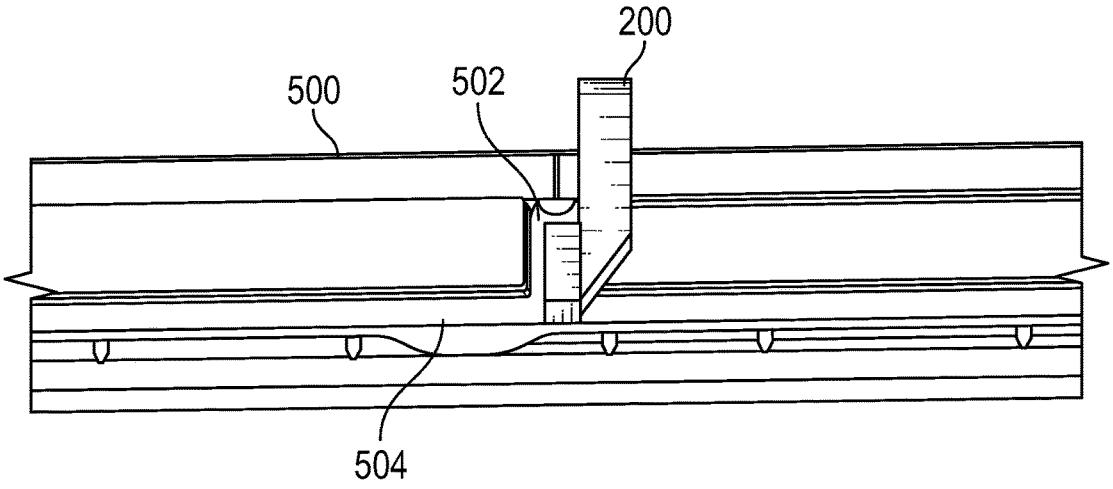
FIGS. 5-10 are side cut away views of a fin box showing the first and second pieces being installed therein.
Figure 6:
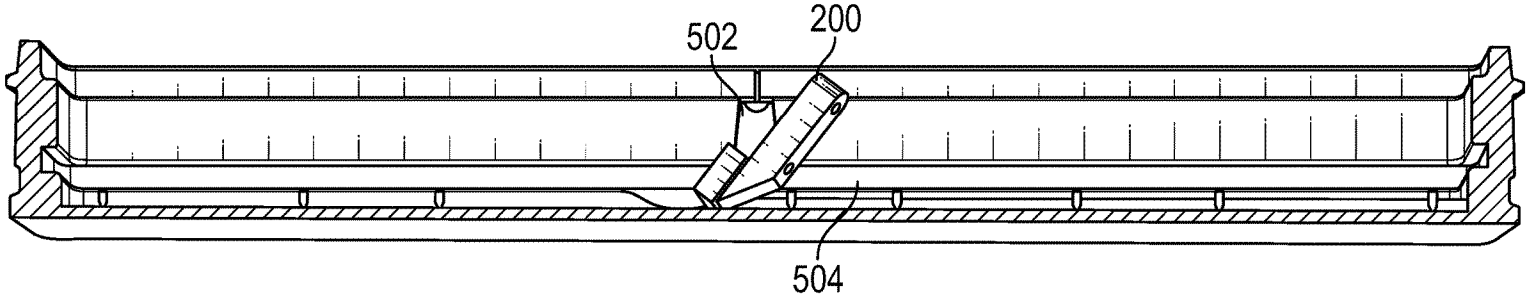
Figure 7:
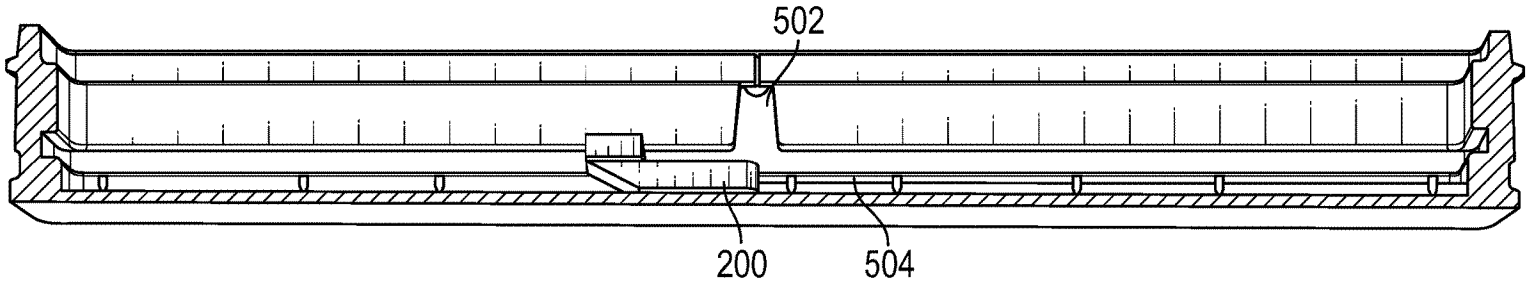
Figure 11:
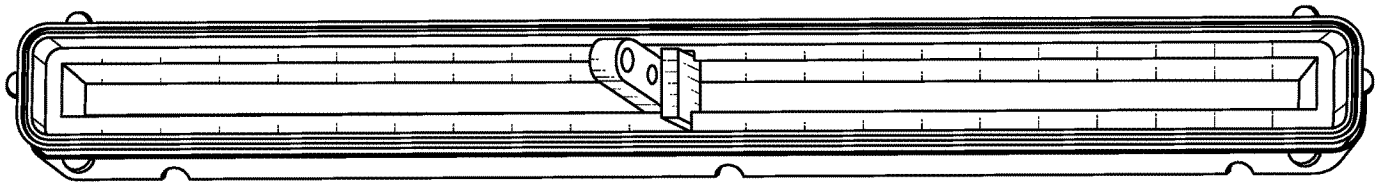
FIG. 11 is an overhead view of FIG. 5 and a side cut away view of a fin box having the pieces shown in FIGS. 1-3 installed in the fin box. The two pieces may be coupled together. When secured together, the device cannot be removed from the fin box. This is because the combined size and shape of the device cannot negotiate the turn required to move from the fin box channel to the fin box opening.
Figure 11:
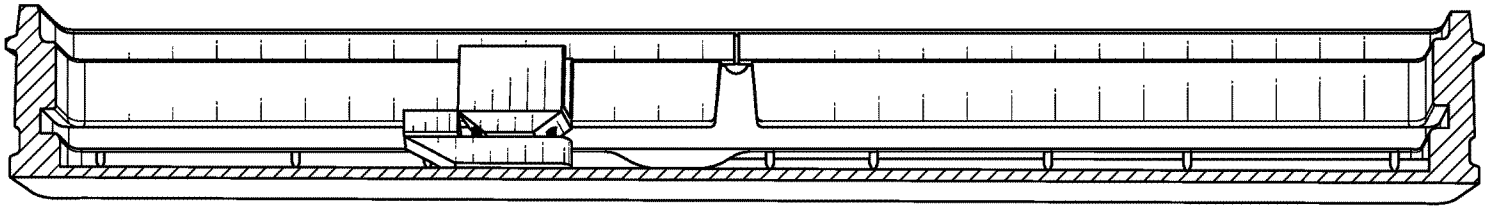
Figure 12:
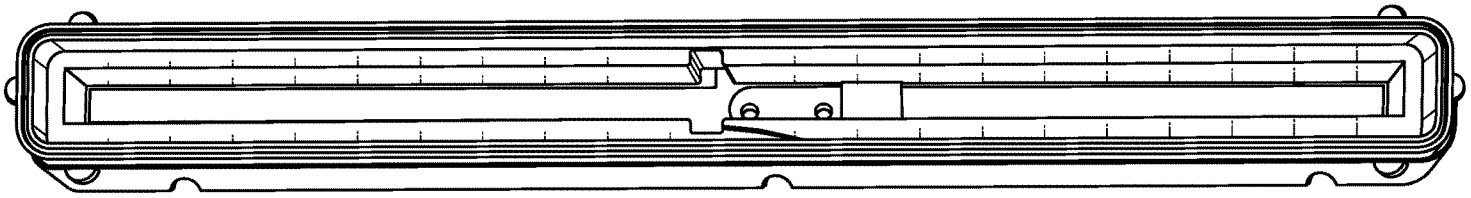
FIG. 12 is an overhead view of the piece shown of FIG. 2 being inserted downward through the fin box opening and into the fin box channel.
Figure 13:
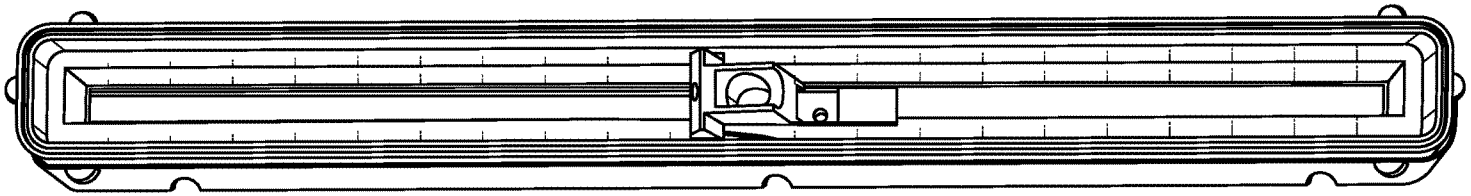
FIG. 13 is an overhead view of the piece of FIG. 1 being inserted downward through the fin box opening and into the fin box channel. As shown the piece of FIG. 2 has previously been inserted into the channel.
Figure 14:
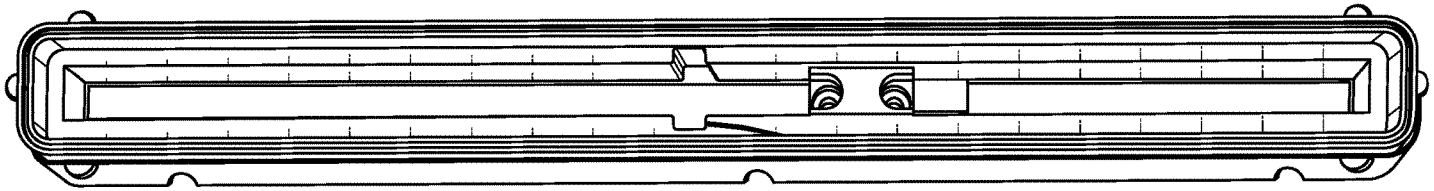
FIG. 14 is an overhead view of the pieces of FIGS. 1-2 both inside the fin box channel.
Figure 15:
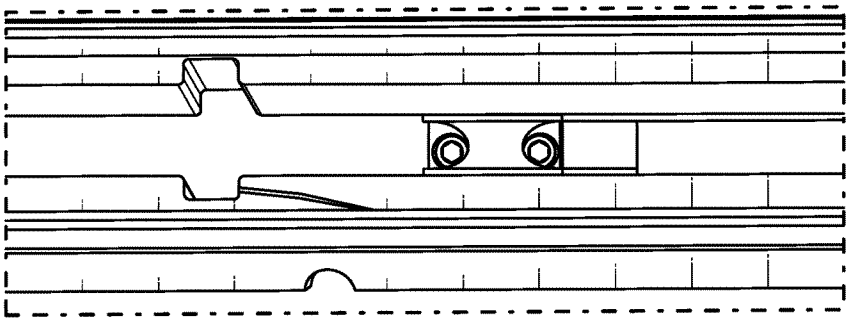
FIG. 15 is an overhead view of the pieces of FIGS. 1-2 coupled together with two screws. The screws may be accessed downward through the channel.

As shown in FIGS. 5-7, the second piece is sized and shaped for insertion into the fin box 500. The second piece may be inserted into the opening 502 at or near the center of the channel 504 and can make the turn required such that it may slide along the ruts in the channel. Then the first piece 100 can be similarly inserted as shown in FIGS. 8-10. However, the order of insertion may be reversed. The pieces 100, 200 may then be joined together. In the embodiment described herein, two screws may be inserted downward through the transverse openings 108 in the first piece and into the threaded holes 204 of the second piece—thus securing the two pieces together. As shown in FIG. 11, the device may be positioned towards the rear of the fin box. In this way, a fin may also be inserted and installed within the fin box.

Figure 16:
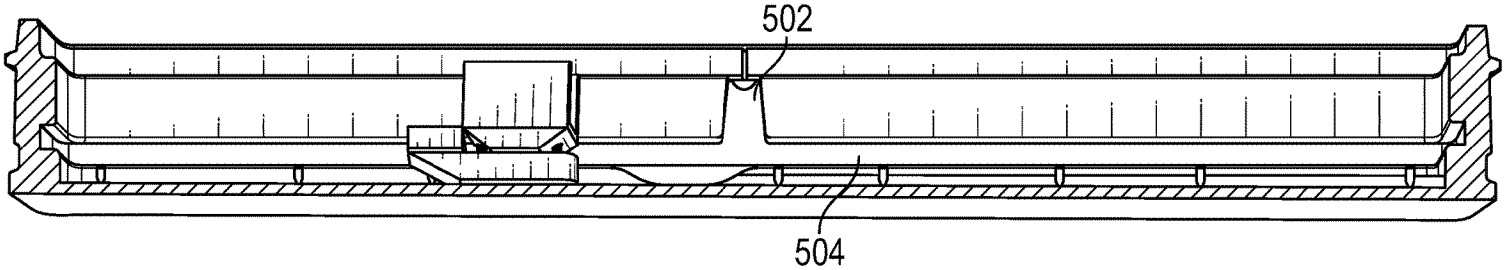
FIG. 16 is a side cut away view of a fin box showing the first and second pieces being installed therein. As shown, the device may be slide forward in the channel such that a fin may also be installed in the fin box.
Figure 17:
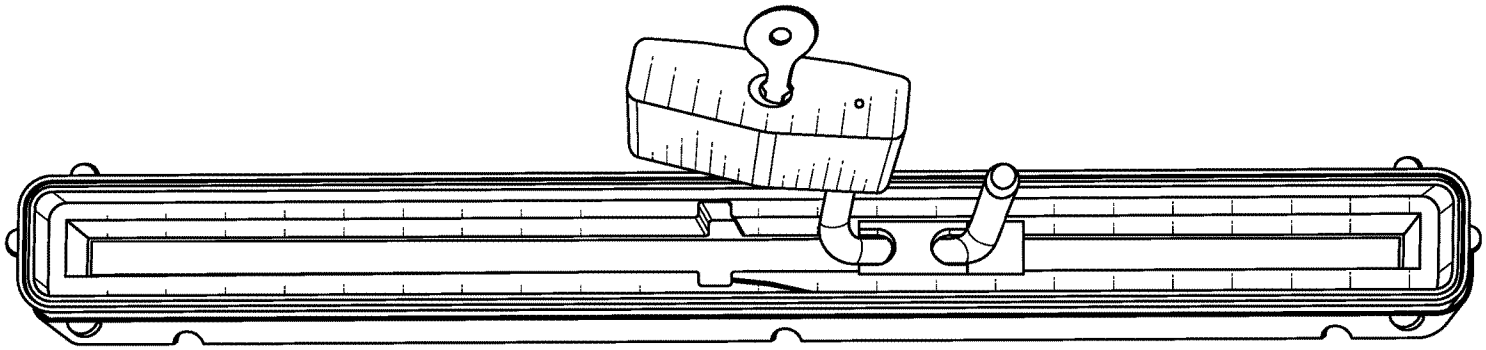
FIG. 17 in an overhead view of the device within a channel of a fin box used in conjunction with a pad lock. As shown the shackle of the pad lock may be inserted through a passageway in the device. Thus, the device provides a securement point for a lock.

When the first and second piece are coupled together, as shown for example in FIG. 16, the device may be capable of sliding forward and backward in the longitudinal direction within the channel. However, the assembled device cannot be removed from the channel. This is because the dimensioning of the combined device prevents the device from making the turn out of the channel and through the wider central opening. As shown in FIG. 17, the positioning of the fastener openings are hidden and rendered inaccessible when something (e.g., the shackle of a padlock) is located within the passageway. As such, the securement cannot be removed from the channel without destroying the fin box and/or surfboard.

It is to be understood that the implementations are not limited to the precise configuration and components illustrated above. Various modifications, changes and variations may be made in the arrangement, operation and details of the methods and apparatus described above without departing from the scope of the implementations.

Although this invention has been described in terms of certain embodiments, other embodiments that are apparent to those of ordinary skill in the art, including embodiments that do not provide all of the features and advantages set forth herein, are also within the scope of this invention. Moreover, the various embodiments described above can be combined to provide further embodiments. In addition, certain features shown in the context of one embodiment can be incorporated into other embodiments as well.

What is claimed is:

1. A device providing a securement point for a surfboard comprising:

a first piece sized and shaped to be insertable into a fin box opening of a fin box of a surfboard; and a second piece sized and shaped to be insertable into the fin box opening, the first and second pieces couplable together within the fin box to form a securement, the securement sized and shaped such that the securement cannot be removed through the fin box opening, wherein the securement includes at least one passageway therethrough capable of receiving at least a portion of a lock, the at least one passageway being disposed within the fin box.

2. The device of claim 1, wherein the lock is a padlock comprising a shackle, and wherein the at least one passageway is sized and shaped to receive the shackle.

3. The device of claim 1, wherein the first piece comprises at least one opening and the second piece comprises at least one threaded hole, such that the first and second pieces can be coupled together within the fin box by driving a screw through the at least one opening into the at least one threaded hole.

4. The device of claim 3, wherein the lock is a padlock comprising a shackle, and wherein the at least one passageway is sized and shaped to receive the shackle, the at least one passageway being located such that access to the at least one opening is prevented when the shackle is disposed within the at least one passageway.

5. The device of claim 1, wherein the first and second pieces comprise at least one of a metal, an epoxy, and a plastic.

6. The device of claim 1, wherein the first piece comprises a central portion and one or more outcroppings wider than the central portion, the one or more outcroppings sized and shaped to be contained within a rut of the fin box, the central portion configured to extend through a central channel of the fin box toward an exterior of the surfboard.

7. The device of claim 6, wherein the second piece comprises a base and a rudder wider than the base, the rudder sized and shaped to be contained within the rut of the fin box, the central portion configured to support the first piece.

8. The device of claim 7, wherein the first piece and the second piece are securable together while the one or more outcroppings and the rudder are disposed within the rut of the fin box.

9. The device of claim 1, wherein at least one of the first piece and the second piece comprises an angled portion configured to facilitate insertion of the securement into the fin box.

10. The device of claim 1, wherein the first piece comprises a central portion having a width less than 0.9 cm and a retention portion having a width greater than 0.9 cm.

11. The device of claim 10, wherein the second piece comprises a base having a width less than 0.9 cm and a rudder having a width greater than 0.9 cm.

12. The device of claim 11, wherein the retention portion and the rudder are substantially aligned when the first and second pieces are secured together.

* * * * *